United States Patent [19]

Conklin

[11] 4,065,336

[45] Dec. 27, 1977

[54] METHOD OF MAKING A WALL SECTION FOR A THERMAL ENCLOSURE

[75] Inventor: Hale Conklin, Santa Ana, Calif.

[73] Assignee: Divajex, Santa Ana, Calif.

[21] Appl. No.: 732,515

[22] Filed: Oct. 14, 1976

Related U.S. Application Data

[62] Division of Ser. No. 608,182, Aug. 27, 1975, Pat. No. 4,019,340.

[51] Int. Cl.[2] ..... B65B 7/00

[52] U.S. Cl. ..... 156/69; 29/157.3 R; 29/450; 62/372; 62/457; 62/530; 156/293; 220/23

[58] Field of Search ..... 62/372, 530, 457; 156/69, 293; 220/23 X; 29/157.3 R, 450

[56] References Cited

U.S. PATENT DOCUMENTS

| | | | |
|---|---|---|---|
| 3,807,194 | 4/1974 | Bond | 62/371 |
| 3,941,275 | 3/1976 | Simmons | 220/23 |
| 4,005,531 | 2/1977 | Weintraub et al. | 36/28 |

*Primary Examiner*—Edward G. Whitby
*Attorney, Agent, or Firm*—Gordon L. Peterson

[57] ABSTRACT

A thermal enclosure comprising a container having a cover which is removable to provide access to the interior of the container. The cover includes a frame having inner and outer ends and a passage extending through the frame. The frame includes a peripheral wall and a ledge which extends radially inwardly from the peripheral wall. An inner end wall is positioned in the passage and is supported on the ledge. An outer end wall is affixed to the peripheral wall. A material for adding or removing heat is provided in the passsage between the end walls.

11 Claims, 6 Drawing Figures

METHOD OF MAKING A WALL SECTION FOR A THERMAL ENCLOSURE

This is a division of application Ser. No. 608,182 filed Aug. 27, 1975 now U.S. Pat. No. 4,019,340.

BACKGROUND OF THE INVENTION

Thermal enclosures are used to keep the contents of the enclosure at a temperature other than ambient for as long a period as possible. A thermal enclosure is a container, one wall of which contains means for adding or removing heat from the interior of the container. For example, such means may include ice or materials which can be mixed to provide either endothermic or exothermic reactions. Such means may also include materials having a relatively high specific heat and/or high heat or fusion.

One material which is particularly adapted for use in a thermal enclosure is refrigerant gel. Refrigerant gel has very high specific heat and a very high heat of fusion. Moreover, it can be readily packaged and reused, and it does not liquify when its temperature exceeds its freezing point, i.e. that temperature where a quantity of heat energy is transferred without any resultant change in temperature due to a change of state. Refrigerant gel is disclosed, by way of example, in U.S. Pat. No. 2,803,115.

One prior art thermal enclosure uses packaged refrigerant gel in the cover of a container to maintain the contents of the container cool. The cover and the refrigerant gel can be cooled in a freezer and then used to maintain a reduced temperature within the container. The cover of this prior art enclosure is hollow and includes a main section and a bottom wall. The main section has a peripheral wall and an upper wall which define a downwardly opening cavity. With the cover inverted, packaged refrigerant gel can be inserted into the cavity of the main section of the cover. Thereafter, the bottom wall is adhesively attached to the main section of the cover to enclose the opening.

With this construction, the bottom wall is outside the cavity defined by the main section of the cover. The edges of the bottom wall are exposed, and during use the bottom wall tends to peel off. The tendency of the bottom wall to separate from the main section of the cover is augmented by the weight of the refrigerant gel acting downwardly against the bottom wall. Because of the tendency of the bottom wall to separate or peel off, it may be carefully glued to the main section of the cover and held under pressure while the glue cures. Even with these precautions, the problem with bottom wall separation cannot be completely remedied.

SUMMARY OF THE INVENTION

The present invention positively prevents the bottom wall from separating from the remainder of the cover and totally eliminates the need for gluing the bottom wall. This facilitates assembly while providing a cover which is not subject to the peeling and separating problems identified above.

The present invention provides a thermal cover which includes a frame, a bottom wall, and an upper wall. The frame has inner and outer ends and a passage extending into the frame in a generally axial direction from the outer end toward the inner end. The frame includes a peripheral wall and a ledge extending radially inwardly from the peripheral wall with the ledge being located axially inwardly of the outer end of the frame.

To eliminate gluing of the bottom wall, the bottom wall is supported on the ledge. So that the edges of the bottom wall will not be exposed, the bottom wall is preferably within the passage in the frame. With this arrangement, there is no adhesive connection between the bottom wall and the frame, and the edges of the bottom wall are concealed.

The ledge provides a strong support for the bottom wall. Although the ledge may extend intermittently around the bottom wall, to provide maximum strength, it preferably extends continuously and completely around the periphery of the bottom wall. The frame can advantageously include a plurality of protrusions for positioning the bottom wall relative to the frame. These protrusions also add strength to the frame.

Means are provided in the passage of the frame for adding or removing heat. Such means include a material of the type described above such as packaged refrigerant gel.

The upper end of the passage is closed by an upper wall. The upper wall may be affixed to the frame or may be releasably mounted on the frame. One advantage of removably mounting the upper wall on the frame is that it can be removed to permit replacement of the heating or cooling material with other heating or cooling material. In addition, if the cover is removed the material such as refrigerant gel can be removed and frozen separately from the cover. This hastens the freezing of the refrigerant gel.

The bottom wall of the cover is exposed to the interior of the thermal container. Accordingly, maximum heat transfer across the bottom wall is desirable. Conversely, heat transfer through the upper wall should be retarded. For this reason, the physical characteristics of the bottom wall are such that more heat transfer can occur across the bottom wall than across the upper wall. For example, the bottom wall may be thinner than the top wall and constructed of material having greater thermal conductivity.

Another feature of the invention is the ease with which the thermal cover can be assembled. To assemble the thermal cover, the bottom wall is passed through the passage of the frame and positioned on the ledge. Next, the package refrigerant gel is placed on the bottom wall and finally the upper wall is mounted on the frame. This is much simpler than prior art assembly techniques which involve relatively complicated and time consuming gluing processes.

The features of the invention are particularly applicable to a thermal cover and are discussed herein with reference to a thermal cover. However, it should be understood that the invention is also applicable to any wall section, whether removable or not, of a thermal enclosure.

The invention can best be understood by reference to the following description taken in connection with the accompanying illustrative drawing.

DESCRIPTION OF THE PREFERRED EMBODIMENT

Figure 1:
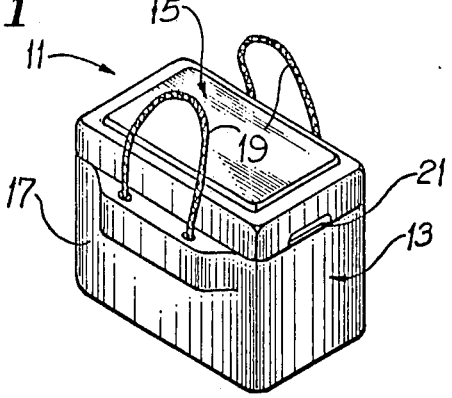
FIG. 1 is a perspective view of a thermal enclosure constructed in accordance with the teachings of this invention.

FIG. 1 shows a thermal enclosure 11 which includes a container section 13 and a removable wall section in the form of a cover 15. The container section 13 is constructed of an insulating material having low thermal conductivity such as foam plastic material. The container section 13 could be of various configurations, and in the embodiment illustrated it has a peripheral wall 17, a bottom wall (not shown), and an open top which is closed by the cover 15. The container section 13 has a pair of handles 19 and a pair of notches 21 (only one being shown in FIG. 1) to facilitate manually transporting the enclosure 11.

Figure 5:
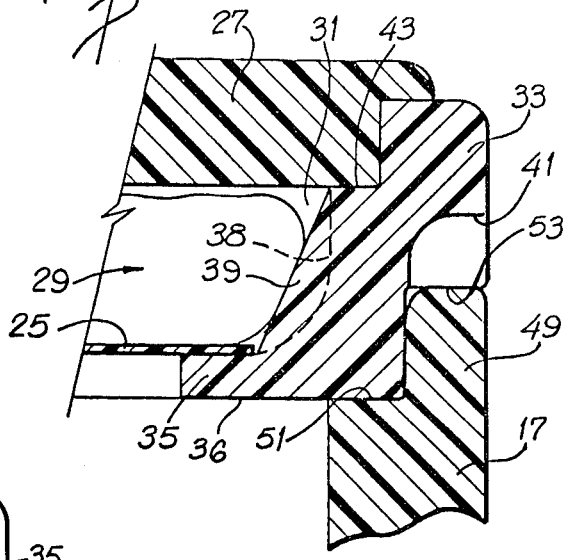
FIG. 5 is an enlarged fragmentary sectional view of a portion of the structure shown in FIG. 3 with the refrigerant gel and upper wall of the cover installed.
Figure 2:
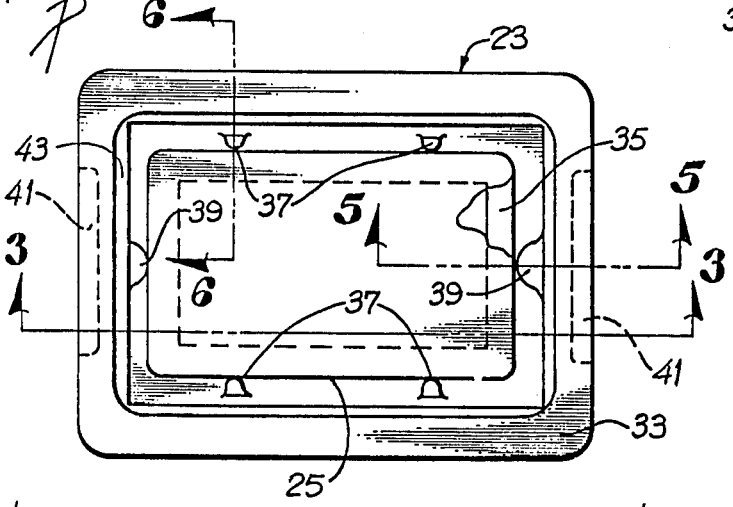
FIG. 2 is a top plan view of a thermal cover constructed in accordance with the teachings of this invention with the upper wall and the package refrigerant gel removed.
Figure 3:
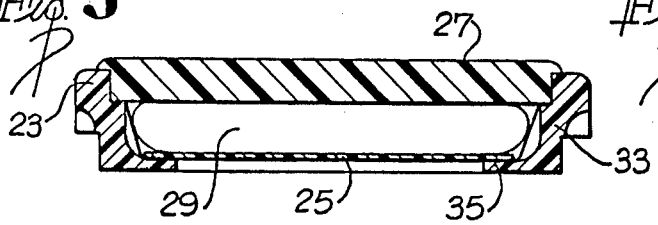
FIG. 3 is a sectional view taken generally along line 3 —3 of FIG. 2.
Figure 4:
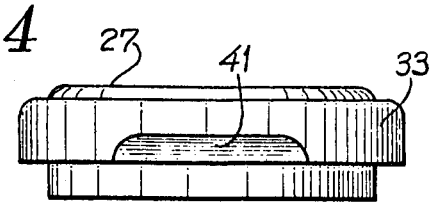
FIG. 4 is an end elevational view of the cover.
Figure 6:
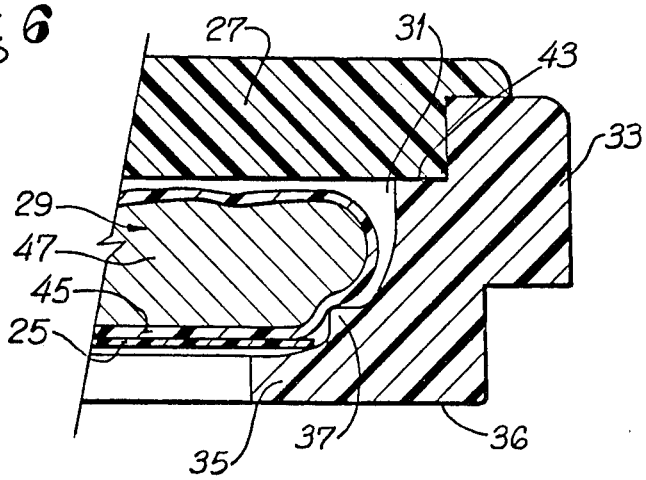
FIG. 6 is an enlarged fragmentary sectional view taken generally along lines 6—6 of FIG. 2 with the refrigerant gel and upper wall of the cover installed.

The cover 15 includes a frame 23, an inner or bottom wall 25, and outer or upper wall 27 (FIGS. 5 and 6), the means 29 for adding or removing heat (FIGS. 3, 5 and 6) The frame 23 in the embodiment illustrated is integrally molded from a suitable insulating material which may be form plastic such as foam polyurethane. The frame 23 is generally in the form of a rectangular ring and has an opening or passage 31 (FIG. 5) which extends completely through it. The frame 23 includes a peripheral wall 33 which surrounds the passage 31 and a ledge 35 which extends radially inwardly from the peripheral wall 33. In the embodiment illustrated, the frame 23 has a lower planar surface 36 which is common to the ledge 35 and the peripheral wall 33 as shown in FIGS. 5 and 6. Although various constructions are possible the ledge 35, in the embodiment illustrated, extends continuously and completely around the passage 31 for 360°. The frame 23 has a smooth concave inner surface 38 which blends the peripheral wall 33 into the ledge 35. This curved surface provides for a stronger ledge than if a notch excited between the ledge and the peripheral wall.

A plurality of protrusions 37 (four being illustrated) are provided along the opposite longitudinal sides of the peripheral wall 33. A pair of protrusions 39 are molded integrally with the end walls of the peripheral wall 33. As its opposite ends, the peripheral wall 33 has cavities which define hand holds 41.

The bottom wall 25 may be of various materials and configurations. In the embodiment illustrated, the bottom wall 25 is in the form of a thin rectangular plate of plastic material. A peripheral portion of the bottom wall 25 rests on and is supported by the ledge 35. The ledge 35 is relatively thick and provides a strong support for the bottom wall 25. As best seen in FIGS. 5 and 6, the bottom wall is spaced axially from the lower surface 36.

The upper wall 27 can advantageously be molded from an insulating material such as foam polyurethane. The peripheral wall 33 has a shoulder 43 which is above the ledge 35 and which extends completely around the passage 31. The upper wall 27 is partly received in the passage 31 and rests on the shoulder 43. The upper wall 27 may be snugly received in the passage 31 in which event the cover 27 is manually removable. Alternatively, the cover 27 may be adhered to the shoulder 43 and/or other contiguous surfaces of the frame 33.

The means 29 for adding or removing heat may be any material or combination of materials which will perform this function. For example, the means 29 may be any of the materials described above as being suitable for this purpose. In the embodiment illustrated, the means 29 includes packaged refrigerant gel. Specifically, the packaged refrigerant gel includes a flexible plastic container 45 (FIG. 6) filled with refrigerant gel 47. The refrigerant gel may be of the type commercially available from Divajex of Santa Ana, Calif. Such gel includes large amounts of water and means to hold the water. The container 45 and the gel 47 are within the passage 31 and are supported by, and rest on, the bottom wall 25.

The cover 15 may cooperate in any suitable way with the peripheral wall 17 of the container section 13 to close the opening in the container section. In the embodiment illustrated, the peripheral wall 17 includes a narrow axial extension 49 (FIG. 5) and a shoulder 51. The peripheral wall 33 has an overhang 53. The cover 15 is partially received by the extension 49, and the lower surface 36 and the overhang 53 rest on the shoulder 51 and the upper end of the extension 49, respectively.

In use the cover 15 is placed in a freezer to freeze the refrigerant gel 47. Thereafter, the cover 15 is placed on the container section 13 and the thermal enclosure 11 can maintain the contents of the enclosure at a reduced temperature. If the upper wall 27 is removable from the frame 23, the refrigerant gel 47 and its container 45 can be removed from the cover 15 and frozen.

To assemble the cover 15, the bottom wall 25 is placed into the passage 31 from the upper end and positioned on the ledge 35. The bottom wall 25 is sized to be received between the protrusions 37 and 39, and accordingly these protrusions help position the bottom wall on the ledge 35. Next, the heating or cooling means 29 is inserted into the passage 31 from the upper end of the passage, and finally the upper wall 27 is mounted on the frame 23 by inserting it into the passage 31. If desired, the upper wall 27 may be adhesively attached to the peripheral wall 33.

Although an exemplary embodiment of this invention has been shown and described, many changes, modifications, and substitutions may be made by those with ordinary skill in the art without necessarily departing from the spirit and scope of this invention.

I claim:

1. A method of making a unitary wall section for at least partly closing an opening in a thermal enclosure wherein the thermal enclosure has surface means adjacent the opening, comprising:

providing a frame having inner and outer ends, a passage extending into said frame in a generally axial direction from said outer end toward said inner end, a peripheral wall, a ledge extending radially inwardly from the peripheral wall with said ledge being axially inwardly of said outer end, and surface means adapted to engage the surface means of the thermal enclosure;

passing a member through said passage from said outer end of said frame to said ledge with an edge portion of said member being supported by said ledge and with said member forming an inner wall of the wall section;

providing a substance for adding or removing heat;

inserting the substance into said passage from said outer end of said frame and depositing the substance on said inner wall; and closing said passage adjacent the outer end of said frame to provide a unitary wall section which can be placed as a unit on the thermal enclosure with the surface means of the frame in engagement with the surface means of the thermal enclosure to at least partly close said opening.

2. A method as defined in claim 1 wherein said step of closing includes providing an outer wall of sufficient size to close said passage adjacent the outer end of the frame, positioning said outer wall on said frame, and affixing the outer wall to the frame.

3. A method as defined in claim 2 wherein said step of affixing includes adhesively securing the outer wall to the frame.

4. A method as defined in claim 1 wherein said first-mentioned step of providing includes providing a frame which is integrally molded from an insulating material.

5. A method as defined in claim 1 including leaving said inner wall free of adhesive attachment to said frame.

6. A method as defined in claim 1 wherein said step of closing includes providing an outer wall having physical characteristics such that more heat transfer occurs across the inner wall than across the outer wall and affixing said outer wall to said frame to close the outer end of said passage.

7. A method as defined in claim 1 wherein said step of closing includes providing an outer wall and removably attaching the outer wall to the frame whereby the substance can be replaced.

8. A method as defined in claim 1 wherein said substance includes packaged refrigerant gel which comprises a container and refrigerant gel in said container.

9. A method of making a unitary cover for a thermal enclosure comprising:

providing a frame having inner and outer ends, a passage extending into said frame in a generally axial direction from said outer end toward said inner end, a peripheral wall, and a ledge extending radially inwardly from the peripheral wall with said ledge being axially inwardly of said outer end;

passing an inner wall through said passage from said outer end of said frame to said ledge with an edge portion of said inner wall being supported by said ledge whereby the inner wall forms an inner wall for the unitary cover;

providing a substance for adding or removing heat;

inserting the substance into said passage from said outer end of said frame and depositing the substance on said inner wall;

closing said passage adjacent the outer end of said frame by mounting an outer wall on the frame whereby said cover can be placed as a unit on the thermal enclosure to at least partially enclose an opening therein; and providing the outer wall with physical characteristics such that more heat transfer can occur across the inner wall than across the outer wall.

10. A method as defined in claim 9 wherein said first-mentioned step of providing includes providing a frame which is integrally molded from an insulating material and said substance includes packaged refrigerant gel which comprises a container and refrigerant gel in said container, said method includes leaving said inner wall free of adhesive attachment to said frame.

11. A method as defined in claim 9 wherein said step of mounting includes releasably mounting the outer wall on the frame.

* * * * *